US006471488B2

(12) United States Patent
Nolan

(10) Patent No.: US 6,471,488 B2
(45) Date of Patent: Oct. 29, 2002

(54) COMPRESSOR WITH ENHANCED OIL CHANGING COVER

(75) Inventor: Patrick B. Nolan, Shelton, CT (US)

(73) Assignee: Stanley Fastening Systems, LP, East Greenwich, RI (US)

( * ) Notice: Subject to any disclaimer, the term of this patent is extended or adjusted under 35 U.S.C. 154(b) by 39 days.

(21) Appl. No.: 09/775,815

(22) Filed: Feb. 5, 2001

(65) Prior Publication Data

US 2001/0038795 A1 Nov. 8, 2001

Related U.S. Application Data

(60) Provisional application No. 60/180,222, filed on Feb. 4, 2000.

(51) Int. Cl.[7] ..... F04B 53/16

(52) U.S. Cl. ..... 417/63; 220/254.1; 220/601; 220/663; 417/234

(58) Field of Search ..... 60/456; 92/153; 137/899.4; 184/1.5; 220/254.1, 601, 663; 222/481; 417/63, 234

(56) References Cited

U.S. PATENT DOCUMENTS

| | | | | | |
|---|---|---|---|---|---|
| 43,625 | A | * | 7/1864 | Parker | 220/601 |
| 2,155,270 | A | * | 4/1939 | Johnson | 220/663 |
| 2,163,391 | A | * | 6/1939 | Aikman | 417/234 |
| 2,345,889 | A | * | 4/1944 | Talbot | 220/663 |
| 3,808,808 | A | * | 5/1974 | Hibbard | 60/456 |
| 4,376,490 | A | * | 3/1983 | Mizusaki | 220/663 |
| 4,441,623 | A | * | 4/1984 | Antoniak | 220/254.1 |
| 4,830,212 | A | * | 5/1989 | Nagashima et al. | 220/663 |

* cited by examiner

*Primary Examiner*—Michael Koczo
(74) *Attorney, Agent, or Firm*—Pillsbury Winthrop LLP

(57) ABSTRACT

The present invention provides a compressor comprising a housing including a main housing body having an interior reservoir for receiving an oil supply and an upright cover fixedly attached to the main body. The cover has an oil discharge opening extending through a lower portion thereof. The lowest surface defines the oil discharge opening being disposed at substantially the same level as a bottom surface defining the reservoir. The highest surface defines the oil discharge opening being above the normal static free surface level of the oil within the reservoir. A removable plug in the oil discharge opening which when removed allows oil in the reservoir to flow outwardly of the oil discharge opening. The cover has an upwardly facing oil flow engaging and configuring surface extending from the opening for defining the discharge flow configuration of oil flowing out of the opening when the plug is removed.

The present invention also provides a compressor wherein the cover includes an exterior upwardly opening funnel shaped structure in an upper portion thereof having an oil filling opening leading from a lower end of the funnel shaped structure. A removable plug in the oil filling opening is configured and positioned to be manually removed to allow the oil filling opening to communicate with the reservoir.

It is preferable to provide a compressor wherein the cover includes both the oil flow engaging and configuring surface extending from oil discharge opening and the exterior upwardly opening funnel shaped structure preceding the oil filling opening. Both these designs incorporated into the cover will facilitate a clean changing of oil.

20 Claims, 6 Drawing Sheets

COMPRESSOR WITH ENHANCED OIL CHANGING COVER

This application claims the benefit of Provisional application Ser. No. 60/180,222, filed Feb. 4, 2000.

FIELD OF THE INVENTION

The present invention relates to air compressors and more particularly to air compressors of the type forming a component of a portable power operated air compressor assembly.

BACKGROUND OF THE INVENTION

Portable power operated air compressor assemblies of the type herein contemplated are well known. A typical use for such assemblies is to provide the compressed air to operate fastener driving devices at locations where a permanent source of air under pressure is not available, as for example at a new building construction site.

A limitation on the life expectancy of power operated air compressor assemblies of this type is a malfunction of the air compressor itself. Many compressors suffer from damage of internal moving parts due to excessive wear. This wear is attributed to infrequent changing of oil at routine intervals. The openings for adding and emptying oil are typically small in diameter and difficult to access. The small and hard to access openings make it difficult to change the oil easily and the process is usually quite messy. Oil is often drained onto the ground because of the limitations in accessing a receptacle under the drain opening. It has been found that this difficult procedure for adding and emptying oil inhibits users from changing the oil of the machine as often as the recommended schedule calls for, which leads to the premature wear of internal components. Thus, there is a need to provide a compressor which facilitates the changing of the oil.

SUMMARY OF THE INVENTION

It is an object of the present invention to meet the above-described need. In accordance with the principles of the present invention this objective is achieved by providing a compressor comprising a housing including a main housing body having an interior reservoir for receiving an oil supply and an upright cover fixedly attached to the main body. The cover has an oil discharge opening extending through a lower portion thereof. The lowest surface defines the oil discharge opening being disposed at substantially the same level as a bottom surface defining the reservoir. The highest surface defines the oil discharge opening being above the normal static free surface level of the oil within the reservoir. A removable plug in the oil discharge opening which when removed allows oil in the reservoir to flow outwardly of the oil discharge opening. The cover has an upwardly facing oil flow engaging and configuring surface extending from the opening for defining the discharge flow configuration of oil flowing out of the opening when the plug is removed.

This objective can also be achieved by providing a compressor wherein the cover includes an exterior upwardly opening funnel shaped structure in an upper portion thereof having an oil filling opening leading from a lower end of the funnel shaped structure. A removable plug in the oil filling opening is configured and positioned to be manually removed to allow the oil filling opening to communicate with the reservoir.

It is preferable to meet the above-described need by providing a compressor wherein the cover includes both the oil flow engaging and configuring surface extending from oil discharge opening and the exterior upwardly opening funnel shaped structure preceding the oil filling opening. Both these designs incorporated into the cover will facilitate a clean changing of oil.

The above-described compressor is incorporated into a portable power operated air compressor assembly comprising a portable frame structure. The power operated air compressor unit carried by the frame structure has a structure constructed and arranged to provide a source of air under pressure when power driven. A containing structure carried by the frame structure is constructed and arranged to receive and contain the source of air under pressure provided by the power operated air compressor unit for use when desired. The portable frame structure includes a base portion providing ground engaging surfaces configured and positioned to engage and support the base portion in generally horizontally extending relation on a horizontal surface. The ground engaging surfaces are spaced below the oil flow engaging and configuring surface sufficient to allow an oil receiving container to be supported on the horizontal surface in a position to receive the flow from the oil flow engaging and configuring surface. For purposes of the present invention, it is sufficient to note that the compressor is fixed to a platform member of the frame structure. The details of the portable power operated air compressor assembly are disclosed in the patent application entitled "Power Operated Air Compressor Assembly," attorney docket number SFS-174, filed concurrently herewith, the entirety of which is incorporated herein by reference.

These and other objects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE INVENTION

Figure 1:
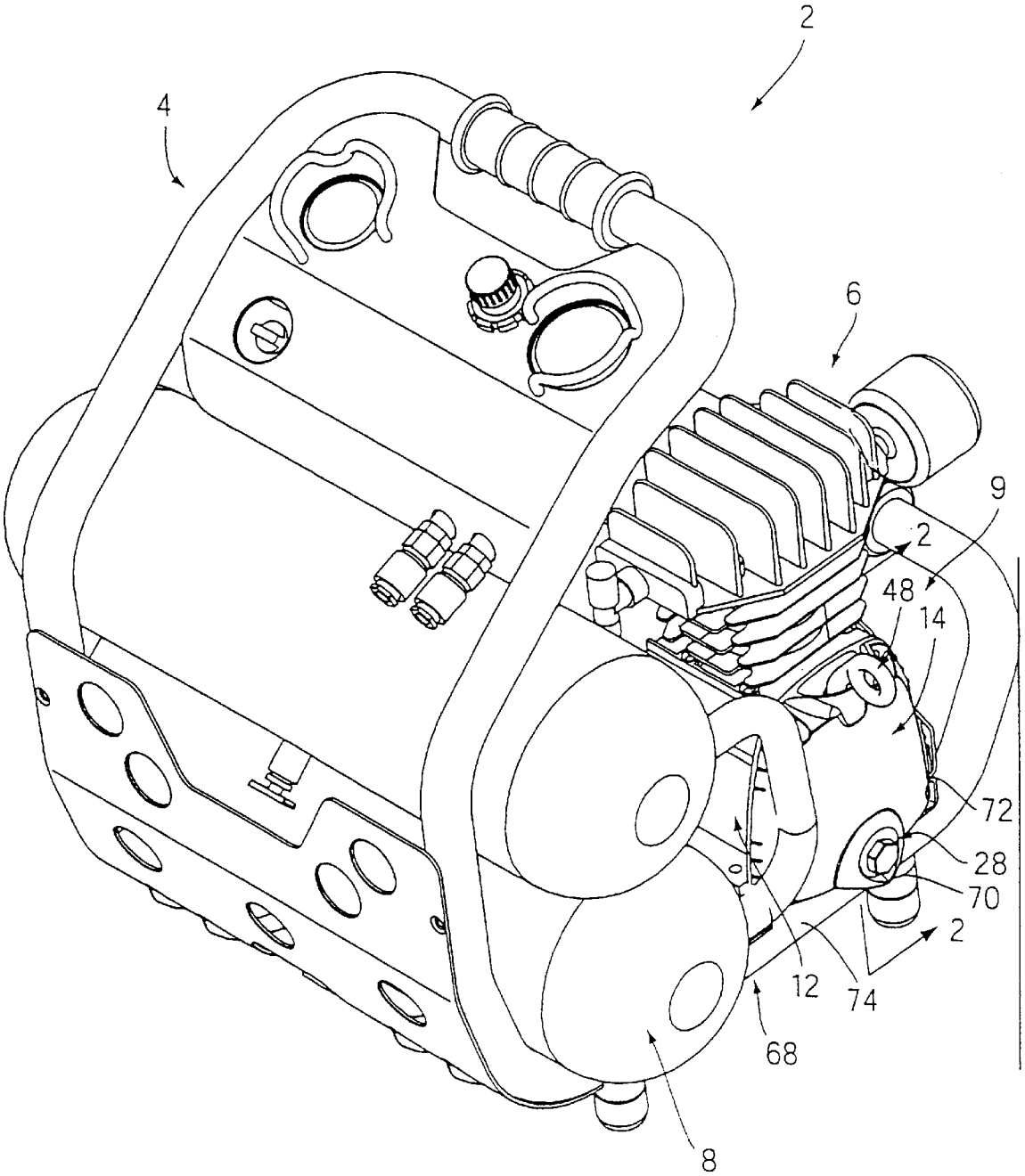
FIG. 1 is a perspective view of a portable power operated air compressor assembly comprising the compressor and accompanying oil changing cover constructed in accordance with the principles of the present invention.
Figure 2:
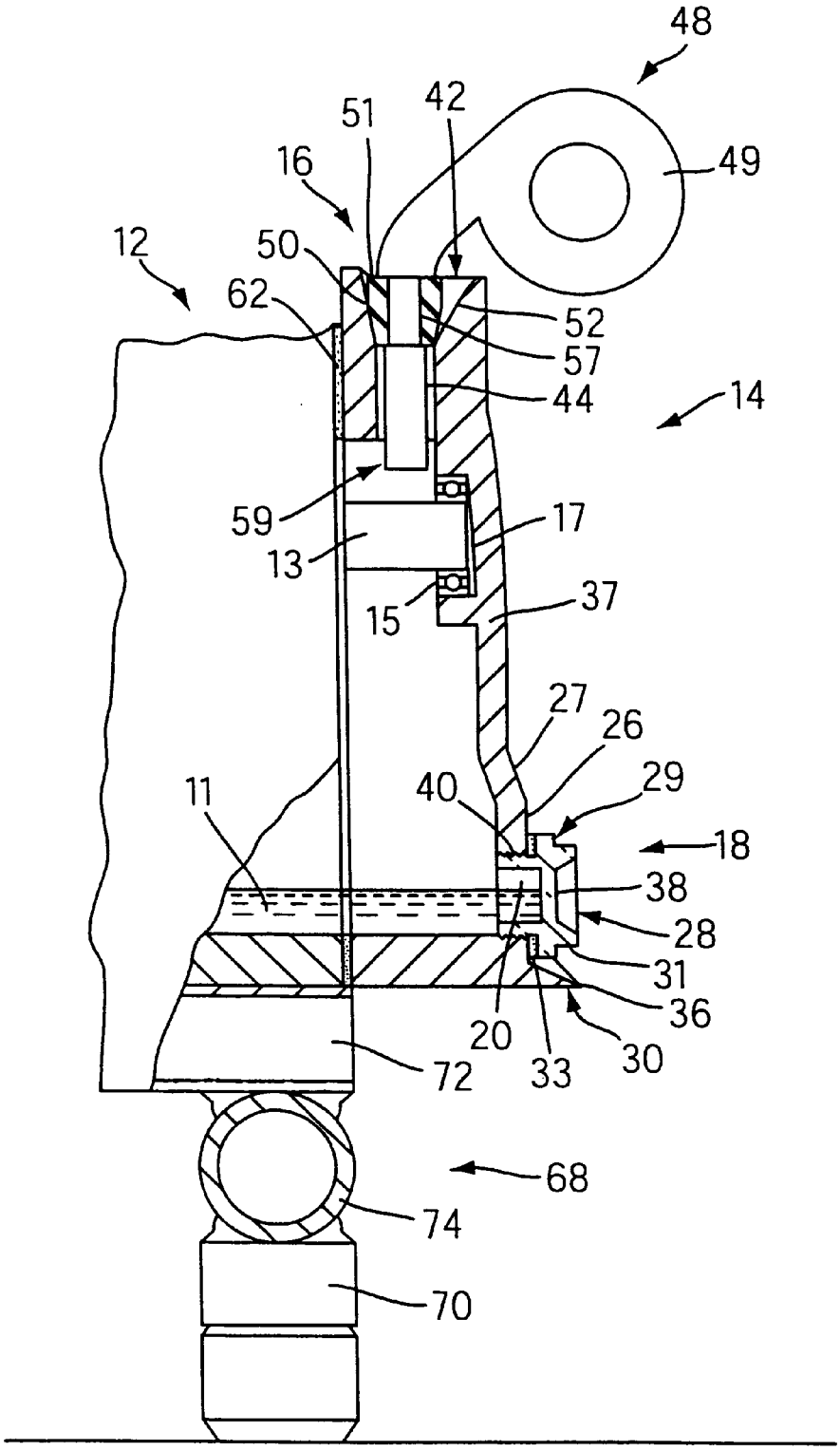
FIG. 2 is a cross-sectional view, taken along line 2—2 of FIG. 1 with an adjacent portion of the compressor housing being shown in broken away elevation.

Referring now more particularly to the drawing there is shown in FIG. 1 thereof a power operated air compressor assembly, generally indicated at 2 which embodies the principles of the present invention. In general, the power operated air compressor assembly 2 includes a frame structure, generally indicated at 4, which carries a power operated air compressor unit, generally indicated at 6, and an air pressure containing structure, generally indicated at 8. The power operated air compressor unit 6 is comprised of conventional components. In the example shown, the power operated compressor unit 6 includes an air compressor, generally indicated at 9, which is of the single piston type driven by an electric motor (not shown) which, in turn, drives a fan cooling system (not shown) for the electric motor and the compressor 9. The present invention is more particularly concerned with the air compressor 9 and more particular with the manner in which the lubricating oil for the compressor is changed. The air compressor 9, as shown, is a single cylinder air compressor using oil to lubricate the internal components. The principles of the present invention have applicability to any oil-lubricated compressor whether utilized in an assembly 2, such as shown, or in other assemblies. The air compressor 9 includes a main housing body or crankcase, generally indicated at 12. An upright oil changing cover shown generally shown at 14 is fixedly attached to the main housing body 12. FIG. 2 shows an interior reservoir 11 within the main housing body 12 and cover 14 for receiving the oil supply. The cover 14 regulates the filing and discharging of the oil supply along with supporting part of the crank mechanism. The air compressor 10 has a crankshaft 13 which is shown along with a bearing 15 within which it is journaled. The bearing 15 and crankshaft 13 are supported by a recessed section 17 within the back portion of the cover 14 thereof. An understanding of the details of construction of the other components of the air compressor assembly 2 and the air compressor 9 thereof, except as herein after stated, is not necessary in order to understand the principles of the present invention and thus will not be detailed herein. The details of the portable power operated air compressor assembly are disclosed in the patent application Ser. No. 09/775,815, entitled "Power Operated Air Compressor Assembly," filed concurrently herewith, the entirety of which is incorporated by reference into the present specification. Instead, the present invention is concerned in detail with the crankcase cover 14 and how it facilitates the changing of oil.

Figure 3:
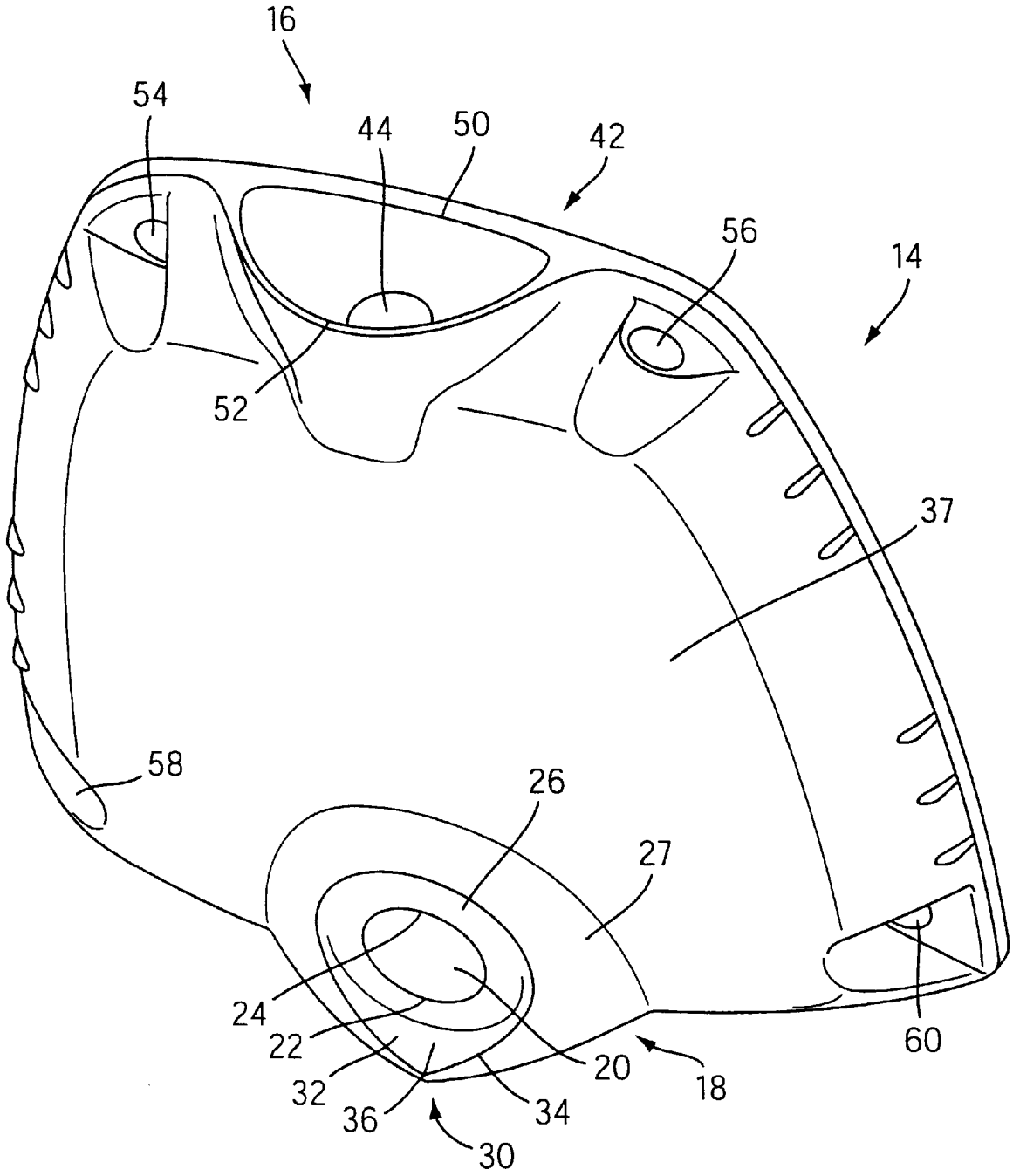
FIG. 3 is a perspective view of the oil changing cover isolated from the remaining components of FIG. 1 constructed in accordance with the principles of the present invention.
Figure 4:
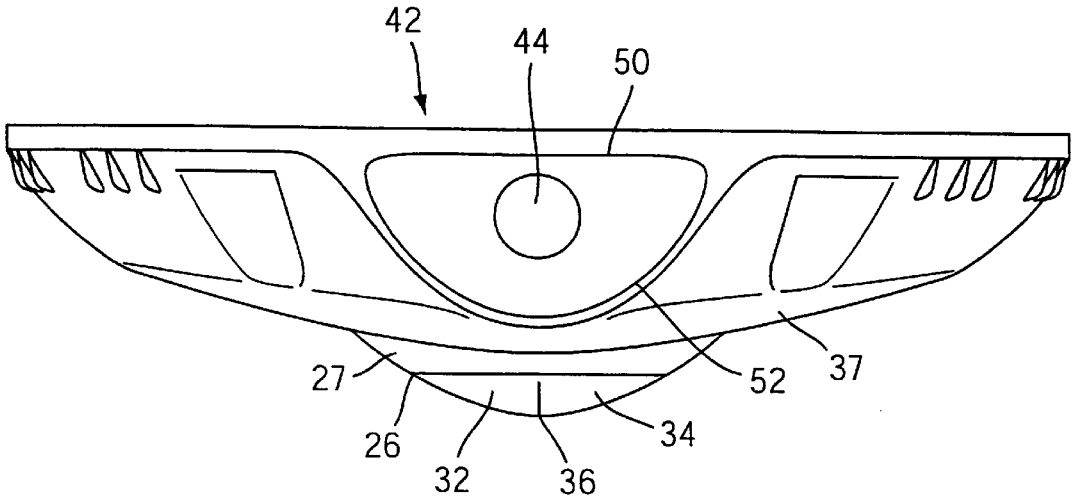
FIG. 4 is a top view of the oil changing cover of FIG. 3.
Figure 5:
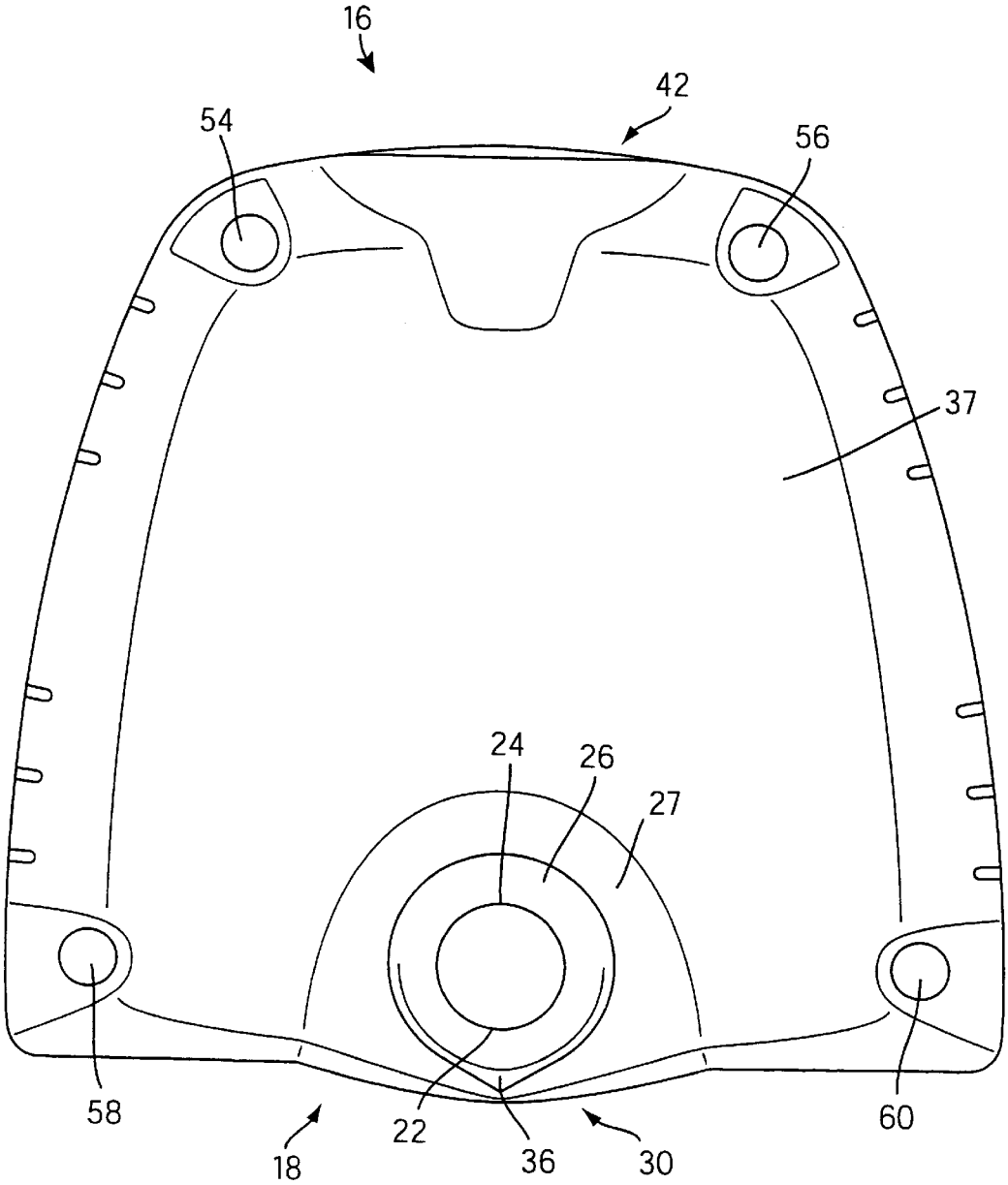
FIG. 5 is a front view of the oil changing cover of FIG. 3.

FIGS. 3–5 show the oil changing cover 14 isolated from the remaining components of the air compressor 9. The cover 14 comprises an oil fill portion shown generally at 16 and an oil discharge portion shown generally at 18. The cover 14 is constructed and arranged to be mounted to the main housing body 12 in an upright position with the oil fill portion 16 defining the top of the cover as shown in the illustrated embodiments of FIGS. 1–2.

Extending through the oil discharge portion 18 of the cover 14 is an oil discharge opening 20 that is threaded. A lowest surface 22 defining the oil discharge opening 20 disposed at substantially the same level as a bottom surface defining the interior reservoir. A highest surface 24 defining the oil discharge opening 20 above the normal static free surface level of the oil within the interior reservoir. The diameter of the discharge opening 20 is substantially larger than the typical designs to promote a more steady flow of oil when emptying and better accessibility. A circular flat surface 26 extends radially from the oil discharge opening 20 providing ample space for a plug to rest and for user accessibility.

Figure 6:
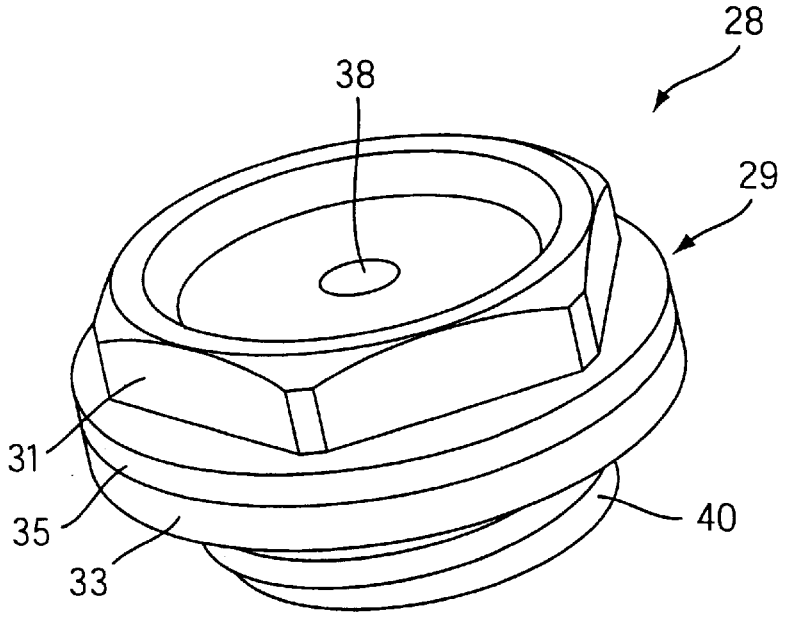
FIG. 6 is a perspective view of the removable plug sealing the oil discharge opening.

An upwardly facing oil flow engaging and configuring surface, shown generally at 30, extends from the bottom half edge of the cylindrical flat surface 26 and defines the discharge flow configuration of oil flowing out of the discharge opening 20 when a discharge plug shown generally at 28 in FIGS. 1, 2, and 6 is removed. The oil flow engaging and configuring surface 30 is spaced below the oil discharge opening 20 by the flat surface 26, thus oil flows down past the flat 26 first before engaging the configuring surface 30 when the plug 28 is removed. The oil flow engaging and configuring surface 30 is generally trough shape with an edge 32 and an edge 34 outwardly converging to a point 36. A portion 27 surrounding the flat surface 26 and the configuring surface 30 gradually angles down and into a front portion 37 of the cover 14 meshing the oil discharge portion 18 therewith.

The removable discharge plug 28 threadably engages with the oil discharge opening 20 with a head portion, shown generally at 29, resting on the flat surface 26 preventing the outwardly flow of oil therethrough. When the plug 28 is removed, oil in the interior reservoir is allowed to flow outwardly through the oil discharge opening 20. The plug 28 is sufficiently transparent to enable a user to view the level of the upper free surface of oil in the interior reservoir. The plug 28 includes a central visual level gauging mark 38, in the form of a red dot, for enabling the user to gauge the position of the existing oil level in relation to a desired normal level as determined by the mark 38. The head portion 29 of the plug 28 includes an outer portion of hexagonal configuration 31 to provide a means of grip for placing or removing the plug 28 therein the discharge opening 20. The plug 28 includes a threaded inner portion 40 configured to threadably engage the oil discharge opening 20 and the outer portion of hexagonal configuration 31. A cylindrical seal 33 located between a flat portion 35 of the head portion 29 and the threaded inner portion 40 provides a tight closure preventing the seepage of oil therethrough the opening 20.

It should be noted that as long as the oil level does not exceed the highest surface 24 defining the oil discharge opening 20 above the normal static free surface level of the oil within the interior reservoir, oil will engage the trough shaped configuring surface 30 when the plug 28 is removed directing the oil to the point 36 where its flow will be defined for collection into a receptacle for recycling. By choosing the position of the oil discharge opening 20 as stated above, the energy level of the oil is minimized so that the outward flow is at a low velocity and follows the direction of the configuring surface 30.

An exterior upwardly opening funnel shaped structure is shown generally at 42 in the oil filling portion 16 of the cover 14. An oil filling opening 44 leading from the lower end of the funnel shaped structure 42 is radially bored therethrough to communicate with the interior of the main housing body 12 therein.

The funnel shaped structure 42 is generally D-shaped at the upper end thereof with a straight portion 50 extending mostly upward from the opening 44 and a curved portion 52 extending upward and outward from the opening 44. The oil fill opening 44 is biased toward the straight portion 50 with the curved portion 52 gradually tapering downwardly to the other sides of the opening 44. The funnel shaped structure 42 and the larger oil fill opening 44 permit the user to not have to line up the oil can to the opening 44 to pour as the portions 50, 52 will move the oil into the opening 44. The funnel shape also accommodates more volume and surface area to pour into than traditional oil fill openings thus allowing the user to pour more quickly and cleanly.

Figure 7:
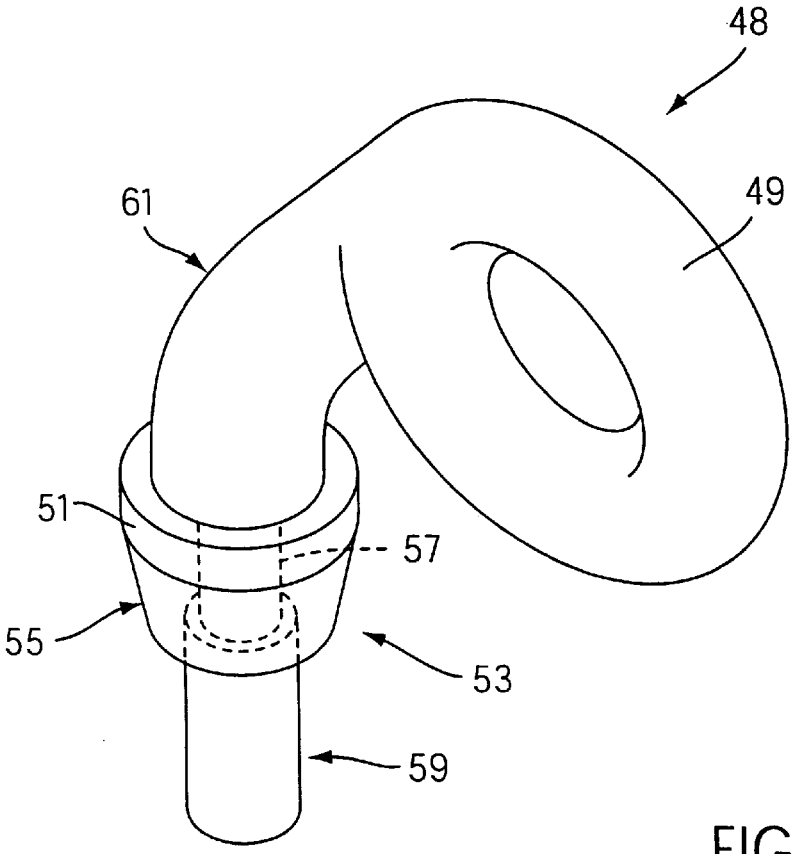
FIG. 7 is a perspective view of the removable plug sealing the oil filling opening.

A removable fill plug, generally shown in FIGS. 1, 2 and 7 at 48, engages oil filling opening 44 which when removed allows the oil filling opening 44 to communicate with the interior of the housing body 12. The plug 48 comprises a ring 49 positioned to be disposed upwardly and outwardly of the oil filling opening 44 when the plug is engaged therein. The ring 49 is configured to enable the user to digitally engage the same and pull up and out to remove the plug 48 from the oil fill opening 44. The plug 48 comprises a cylindrical rubber stopper 51 configured to permit a friction-fit type seal with the oil fill opening 44. The stopper 51 deforms to the contour of the opening 44 to permit this seal. A tubular body portion shown generally at 53 of the plug 48 is configured to support the ring 49 and the stopper 51. A middle portion shown generally at 55 therein the body portion 53 comprises an undercut area 57 therein to house the stopper 51. A lower portion shown generally at 59 is constructed such that the diameter is substantially less than the diameter of the oil fill opening 44 to permit the lower portion 59 to be disposed therein the oil fill opening 44. An upper portion shown generally at 61 is constructed such that the diameter is very similar to the diameter of the ring.

The crankcase cover 14 has aligned and generally circular holes 54, 56 that are bored through the recessed corners of the oil fill portion 16. The crankcase cover 14 has aligned and generally circular holes 58, 60 that are bored through the recessed corners of the oil discharge portion 18. The cover 14 is flushly mounted to the main housing body 12 by use of bolts inserted through these holes 54, 56, 58, and 60.

A seal 62, shaped like the perimeter of the cover 14, is inserted between the cover 14 and housing body 12 to prohibit the leakage of oil from the interior thereof.

Referring now more particularly to FIG. 2, the frame structure 4 includes a base portion, shown generally at 68, providing a ground engaging surface 70 configured and positioned to engage and support the base portion 68 in generally horizontally extending relation on a horizontal surface. The ground engaging surfaces 70 are spaced below the oil flow engaging and configuring surface 30 sufficient to allow an oil receiving container to be supported on the horizontal surface in a position to receive the flow from the oil flow engaging and configuring surface 30. For purposes of the present invention, it is sufficient to note that the compressor 9 is fixed to a platform member 72 which is welded to a tubular frame member 74 of the frame structure 4.

The following invention features the oil fill opening 44 and oil discharge opening 20 prominently located on the cover 14 with a built-in funnel shaped structure 42 for filling and a built-in engaging and configuring surface 30 for emptying the oil. Although either one would be helpful, both designs incorporated into the cover 14 is preferred. Assuming a normal working load, a typical oil change would occur at the passage of a period of time, for example three months. The transparent discharge plug 28 can aid the user in determining that an oil changing interval is at hand. Preferably, a receptacle is placed under the engaging and configuring surface 30 to collect the oil. The portable frame structure 4 substantially elevates the compressor 9 to provide ample space for an oil receiving container. This eliminates the usual need to raise the assembly 2 or simply drain the oil onto the ground. The oil openings are also large and easy to access eliminating any maneuvering that has been typically necessary. The discharge plug 28 is then removed and the built-in engaging and configuring surface 30 directs the oil to the tapered point 36 where its flow will be defined for a clean collection in the receptacle positioned below. Once the housing body 12 is empty, the plug 28 is replaced and the fill plug 48 is removed. The new oil is then poured through the built-in funnel shaped structure 42 providing a large volume and surface area to pour into without aiming, thus fill time is not only cleaner and easier but faster. In situations where the predetermined amount of oil to be filled is not in a convenient container, the level of oil may be gauged periodically through the transparent discharge plug 28 to determine the normal working level. The central visual level gauging mark 38, in the form of a red dot, on the plug 28 clearly defines the normal level of oil. Once full, the fill plug 48 is replaced and the used oil receptacle may be disposed of properly. The process described above is simple and reduces the mess typically involved with adding oil. The user is no longer inhibited to change oil so the compressor component 9 will operate at an optimal level and fulfill a satisfying life expectancy. Thus, the entire assembly is benefited.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A compressor comprising:

a housing containing fluid compressing structure constructed and arranged to provide a supply of fluid under pressure;

said housing including a main housing body having an interior reservoir positioned and configured to receive an oil suitable to lubricate said fluid compressing structure and an cover fixedly attached to said main housing body which is upright when said housing is in an oil changing position;

said cover having an oil discharge opening extending through a lower portion thereof when said housing is in said oil changing position;

the lowest surface defining the oil discharge opening being disposed at substantially the same level as a bottom surface defining said reservoir when said housing is in said oil changing position;

the highest surface defining said oil discharge opening being above the normal static free surface level of the oil within said reservoir when said housing is in said oil changing position;

a removable plug in said oil discharge opening which when removed allows oil in said reservoir to flow outwardly of said oil discharge opening;

said cover having an upwardly facing oil flow engaging and configuring surface extending from said opening for defining the discharge flow configuration of oil flowing out of said opening when said plug is removed.

2. A compressor as defined in claim 1 wherein said oil flow engaging and configuring surface is spaced below said oil discharge opening.

3. A compressor as defined in claim 2 wherein said upwardly facing oil flow engaging and configuring surface is generally trough shape with outwardly converging edges.

4. A compressor as defined in claim 3 wherein the outwardly converging edges converge to a point.

5. A compressor as defined in claim 4 wherein said plug is sufficiently transparent to enable a user to view the level of the upper free surface of the oil in the reservoir.

6. A compressor as defined in claim 5 wherein said plug includes a central visual level gauging mark for enabling the user to gauge the position of the existing oil level in relation to a desired normal level as determined by said mark.

7. A compressor as defined in claim 6 wherein said plug includes a threaded inner portion configured to threadably engage said oil discharge opening and an outer portion of hexagonal configuration.

8. A compressor as defined in claim 7 wherein said cover includes an exterior upwardly opening funnel shaped structure in an upper portion thereof having an oil filling opening leading from a lower end of said funnel shaped structure;

a removable plug in said oil filling opening which when removed allows said oil filling opening to communicate with said reservoir.

9. A compressor as defined in claim 1 wherein said plug is sufficiently transparent to enable a user to view the level of the upper free surface of the oil in the reservoir.

10. A compressor as defined in claim 9 wherein said plug includes a central visual level gauging mark for enabling the user to gauge the position of the existing oil level in relation to a desired normal level as determined by said mark.

11. A compressor as defined in claim 10 wherein said plug includes a threaded inner portion configured to threadably engage a said oil discharge opening and an outer portion of hexagonal configuration.

12. A compressor as defined in claim 1 wherein said cover includes an exterior upwardly opening funnel shaped structure in an upper portion thereof having an oil filling opening leading from a lower end of said funnel shaped structure;

a removable plug in said oil filling opening configured and positioned to be manually removed to allow said oil filling opening to communicate with said reservoir.

13. A compressor comprising:

a housing containing fluid compressing structure constructed and arranged to provide a supply of fluid under pressure;

said housing including a main housing body having an interior reservoir positioned and configured to receive an oil supply suitable to lubricate said fluid compressing structure and a cover fixedly attached to said main housing body which is upright when said housing is in an oil changing position;

said cover including an exterior upwardly opening funnel shaped structure in an upper portion thereof having an oil filling opening leading from a lower end of said funnel shaped structure when said housing is in said oil changing position; and a removable plug in said oil filling opening configured and positioned to be manually removed to allow said oil filling opening to communicate with said reservoir when said housing is in said oil changing position.

14. A compressor as defined in claim 13 wherein said removable plug is configured and positioned to be frictionally engaged within said oil filling opening and includes a ring positioned to be disposed upwardly and outwardly of said oil filling opening when said removable plug is engaged therein configured to enable the user to digitally engage the same to remove the plug from the oil filling opening.

15. A compressor as defined in claim 14 wherein said exterior upwardly opening funnel shaped structure is generally D-shaped at an upper end thereof and tapers downwardly to said oil filling opening.

16. A compressor as defined in claim 13 wherein said exterior upwardly opening funnel shaped structure is generally D-shaped at an upper end thereof and tapers downwardly to said oil filling opening.

17. A portable power operated air compressor assembly comprising:

a portable frame structure;

a power operated air compressor unit carried by said frame structure having structure constructed and arranged to provide a source of air under pressure when power driven, and containing structure carried by said frame structure constructed and arranged to receive and contain the source of air under pressure provided by said power operated air compressor unit for use when desired;

said portable frame structure including:

a base portion providing ground engaging surfaces configured and positioned to engage and support said base portion in generally horizontally extending relation on a horizontal surface;

said power operated air compressor unit including a compressor comprising:

a housing including a main housing body having an interior reservoir for receiving an oil supply and an upright cover fixedly attached to said main housing body when said base portion is supported in said generally horizontally extending relation;

said cover having an oil discharge opening extending through a lower portion thereof when said base portion is supported in said generally horizontally extending relation;

the lowest surface defining the oil discharge opening being disposed at substantially the same level as a bottom surface defining said reservoir when said base portion is supported in said generally horizontally extending relation;

the highest surface defining said oil discharge opening being above the normal static free surface level of the oil within said reservoir when said base portion is supported in said generally horizontally extending relation;

a removable plug in said oil discharge opening which when removed allows oil in said reservoir to flow outwardly of said oil discharge opening;

said cover having an outwardly facing oil flow engaging and configuring surface extending from said opening for defining the discharge flow configuration of oil flowing out of said opening when said plug is removed;

said ground engaging surfaces being spaced below said oil flow engaging and configuring surface sufficient to allow an oil receiving container to be supported on the horizontal surface in a position to receive the flow from the oil flow engaging and configuring surface.

18. A compressor as defined in claim 17 wherein said plug is sufficiently transparent to enable a user to view the level of the upper free surface of the oil in the reservoir;

said plug includes a central visual level gauging mark for enabling the user to gauge the position of the existing oil level in relation to a desired normal level as determined by said mark.

19. A compressor as defined in claim 18 wherein said plug includes a threaded inner portion configured to threadably engage said oil discharge opening and an outer portion of hexagonal configuration.

20. A compressor as defined in claim 17 wherein said cover includes an exterior upwardly opening funnel shaped structure in an upper portion thereof having an oil filling opening leading from a lower end of said funnel shaped structure;

a removable plug in said oil filling opening which when removed allows said oil filling opening to communicate with said reservoir.

* * * * *